US008905790B2

(12) United States Patent
Staudigel et al.

(10) Patent No.: US 8,905,790 B2
(45) Date of Patent: Dec. 9, 2014

(54) CONNECTORS WITH POWER AND SIGNAL CONTACT STRUCTURES

(75) Inventors: Norbert Staudigel, Neu-Ulm (DE); Franz Pacher, Roth (DE)

(73) Assignee: Molex Incorporated, Lisle, IL (US)

( * ) Notice: Subject to any disclaimer, the term of this patent is extended or adjusted under 35 U.S.C. 154(b) by 823 days.

(21) Appl. No.: 13/124,908

(22) PCT Filed: Oct. 24, 2008 (Under 37 CFR 1.47)

(86) PCT No.: PCT/US2008/081112
§ 371 (c)(1), (2), (4) Date: Nov. 12, 2012

(87) PCT Pub. No.: WO2010/047715
PCT Pub. Date: Apr. 29, 2010

(65) Prior Publication Data

US 2013/0164986 A1 Jun. 27, 2013

(51) Int. Cl.

| | |
|---|---|
| ***H01R 33/92*** | (2006.01) |
| ***H01R 13/50*** | (2006.01) |
| ***H01R 13/514*** | (2006.01) |
| ***H01R 12/50*** | (2011.01) |
| *H01R 13/622* | (2006.01) |
| *H01R 13/6464* | (2011.01) |
| *H01R 13/6585* | (2011.01) |

(52) U.S. Cl.
CPC ..... *H01R 13/50* (2013.01); *H01R 13/514* (2013.01); *H01R 23/7073* (2013.01); *H01R 13/622* (2013.01); *H01R 13/6464* (2013.01); *H01R 13/6585* (2013.01)
USPC ..... 439/638; 439/607.05

(58) Field of Classification Search
CPC .. H01R 23/7073; H01R 23/688; H01R 29/00; H01R 25/003
USPC ..... 439/502, 638, 607.05, 607.08, 660
See application file for complete search history.

(56) References Cited

U.S. PATENT DOCUMENTS 6,746,284 B1 6/2004 Spink, Jr.

FOREIGN PATENT DOCUMENTS

| | | | |
|---|---|---|---|
| DE | 29804728 | * | 7/1999 |
| DE | 20-2006-019107 | | 2/2007 |
| EP | 1936758 | * | 6/2008 |

* cited by examiner

*Primary Examiner* — Khiem Nguyen
(74) *Attorney, Agent, or Firm* — Larry I. Golden

(57) ABSTRACT

This disclosure generally pertains to connectors having a signal contact assembly containing a plurality of rod-shaped signal contact members, generally cylindrical dielectric material encasing the sides of the signal contact members and a generally cylindrical conductive shield in contact with the dielectric material. The signal contact assembly along with rod-shaped power contact members are placed in the connector. This combination can be considered to be in the nature of a connector within a connector. The connector can transmit data at 100 Mbps or greater along with power while minimizing the space required for the contacts. The connectors may be generally circular in cross-section.

25 Claims, 10 Drawing Sheets

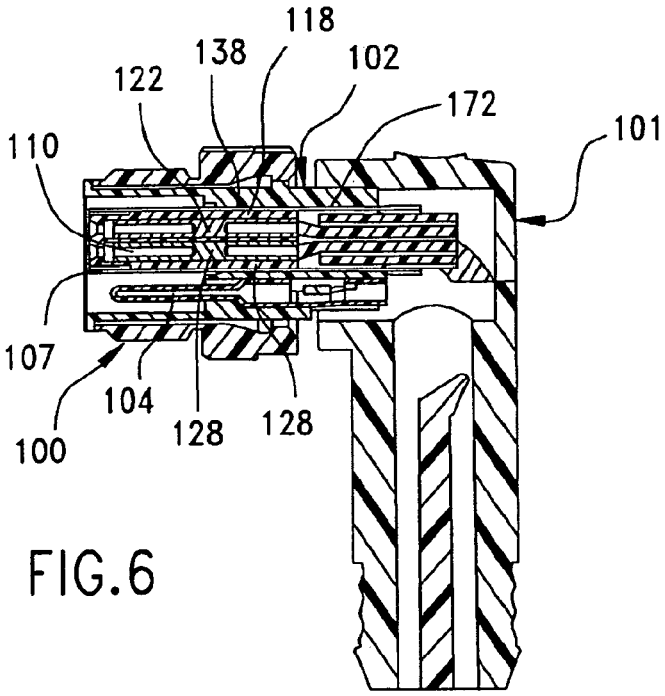
FIG.6
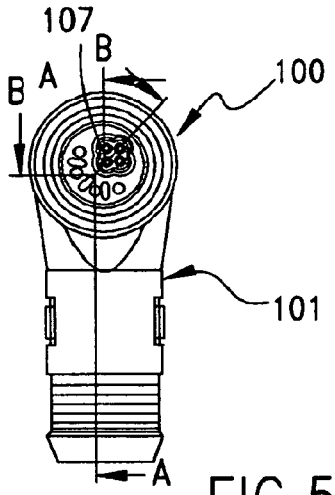
FIG.5
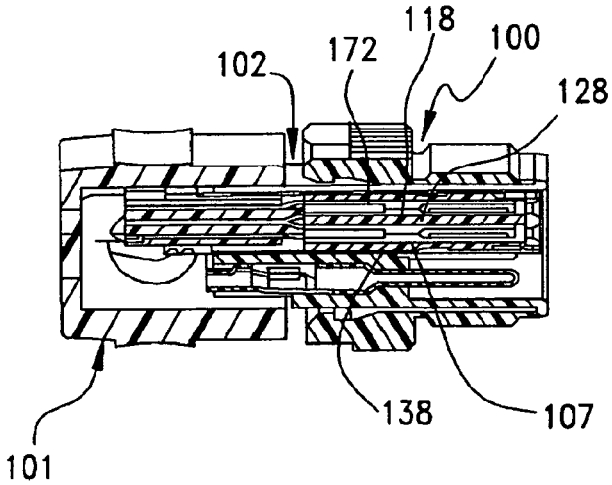
FIG.7
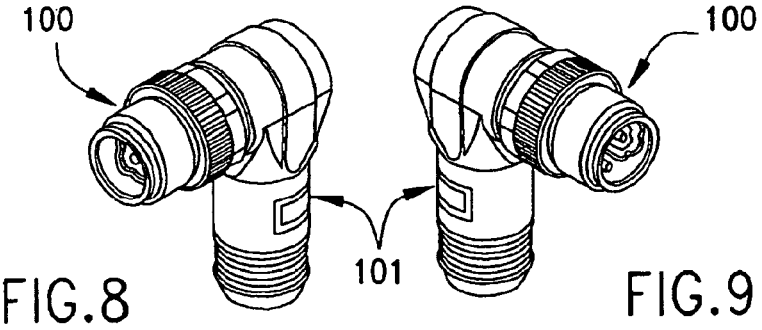
FIG.8
FIG.9

FIG.15
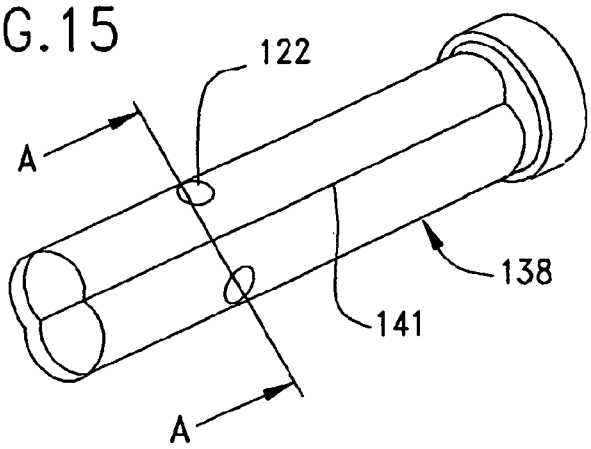
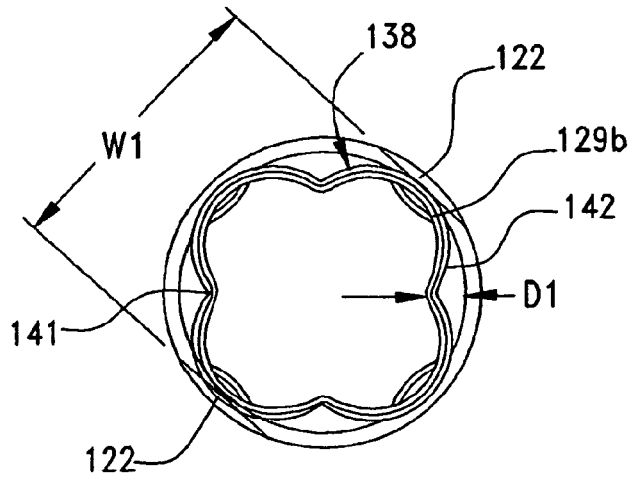
FIG.15A
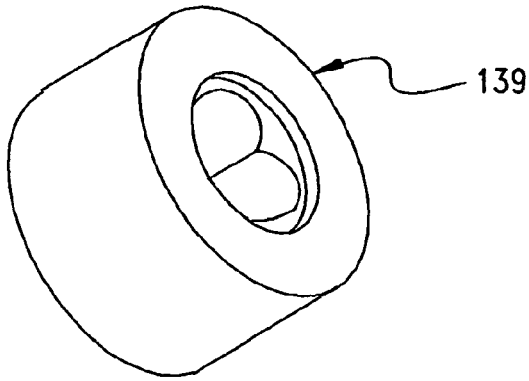
FIG.16

CONNECTORS WITH POWER AND SIGNAL CONTACT STRUCTURES

BACKGROUND OF THE INVENTION

This present invention, generally pertains to connectors and in particular to contact configurations and materials as well as to the structure securing the contacts within the connectors. Mating parts of the connectors each include both power contacts and signal contacts which can be considered to be in the nature of a signal connector and the combination power and signal components can be referred to as a connector within a connector. These power and signal components are arranged in a desired manner and comprise male, female, or both male and female contacts.

DESCRIPTION OF BACKGROUND ART

It is generally known that connectors can be employed for cable-to-cable and cable-to-board connections. For example, in IEC Project Document No. 61076-2-101, Ed. 2, a variety of circular connector styles and contact configurations are described. The present disclosure includes the realization that prior art approaches could be improved if it were possible to depart from prior art connector contact configurations, structures securing the contacts within the connectors and methods for assembling the contacts within the connectors.

Goals have been arrived at in accordance with the present approach so as to provide good electrical performance while minimizing the space required for the contacts. The invention also includes the realization that, in furtherance of these goals of the present approach, additional advantages could be obtained if it were possible to change the structure of the connectors surrounding the structure that secures the contacts within the connectors and to employ more flexibility in the assembly of the connectors.

Prior art approaches that either have not recognized the positives that could be gained by seeking to achieve these types of objectives or teach solutions other than those of the present approach include U.S. Pat. No. 5,487,677. This patent pertains to a hermaphrodite electrical connector providing electric power supply wiring that minimizes the risk of accidental disconnection. The connector comprises at least one female part fitted with a socket and at least one male contact part fitted with a contact pin. This patent does not describe circular connectors or connectors with features that include structures for securing contacts to a circular connector that provide good electrical performance while minimizing the space required for the contacts. Other patents exhibiting the same or similar shortcomings include the following.

U.S. Pat. No. 5,575,690 relates to an electrical connector system comprised of a family of interlocking modules. The modules provide hybrid electrical connectors for power distribution and signal circuit interconnection between printed circuit boards. U.S. Pat. No. 6,114,632 pertains to an integrated power and data communications hybrid cable assembly for local area computer networks. Hybrid cable is electrically coupled between an outlet and a panel to provide power and data transfer between the panel and the computer workstations. The panel and the outlet are each divided into an enclosed power section and a separate enclosed voice/data section. The panel walls and the outlet walls of each section are covered with a magnetic shielding material such as barium ferrite. U.S. Pat. No. 6,500,026 relates to a hybrid connector in which electrical and optical connectors are integrally formed. A single connecting operation completes the connection between the electrical and optical connectors. U.S. Pat. No. 6,768,059 relates to an electric crimping tool die set for crimping an asymmetrical electrical connector onto electrical conductors. This patent does not describe circular connectors or devices with features that include providing structure for securing contacts to a circular connector that provide good electrical performance while minimizing the space required for the contacts.

U.S. Pat. No. 7,056,160 pertains to a hybrid electrical connector that includes both signal and power contacts in the same housing. The housing of the connector has a plurality of cavities for signal contacts and a plurality of cavities for power contacts. U.S. Pat. No. 7,112,092 relates to a coaxial plug connector that has an outer conductive sleeve. The sleeve is formed by bending a blank whose basic shape is produced by stamping or punching from sheet metal. U.S. Pat. No. 7,306,472 pertains to a round connector in which a plug connector is inserted axially into a receptor connector. The plug connector is removed from the receptor connector by rotating a coupling ring. The patent also discloses plate-like signal contacts aligned in a row that are unshielded and power contacts surround the signal contacts.

With the present approach, it has been determined that various characteristics of prior art, such as these patents, have shortcomings and undesirable attributes, results or effects. The present approach recognizes and addresses matters such as these to provide enhancements not heretofore available. Overall, the present approach provides more fully enhanced connectors that connect cable to cable and cable to board.

SUMMARY OF THE INVENTION

An embodiment of the present approach generally pertains to producing a signal contact assembly, which can be referred to as a connector component, for inserting multiple signal contacts as a unit into a connector along with individual power contacts. This allows signal contacts to be assembled first into a smaller connector that can more efficiently address factors specific to the signal connectors such as fitting smaller contacts into a housing.

Another embodiment of the present approach is forming a contact configuration by placing a signal contact connector assembly biased to one side of the connector housing providing space in the other side of the connector housing to disperse the placement of power contacts between the outer wall of the connector housing and the signal contact assembly.

Another embodiment of the present approach in general provides conductive material as part of a signal contact assembly. The conductive material provides a shield to protect signal data transmission and provides good electrical performance in adverse EMI/EMC conditions.

Another embodiment of the present approach pertains to separating the signal contacts and the conductive shielding material with a dielectric material having a dielectric constant below about 2.6 such as polypropylene, a fluorocarbon resin such as polytetrafluoro ethylene (PTFE) Teflon® resin, or a liquid crystal polymer (LCP). This minimizes signal distortion resulting from the capacitor formed by the signal contacts and lines to it, the dielectric and the shield. The low dielectric constant of these materials also minimizes the distance of separation between the signal contacts and the shield that allows for smaller signal contact assembly size.

An additional embodiment of the present approach relates to placing both male and female contacts in the same generally circular connector for flexibility in contact configuration design. Enhanced electrical performance is provided by the materials used together with male and female terminals or contacts in each of the mating connectors. As a result connectors with reduced circumference dimension can reliably transmit data at 100 Mbps or greater such that the connectors are compatible with category 5 cable and higher.

A further embodiment of the present approach relates to pressing lines of indentation into the shield, which can be provided to strengthen the shield structure, reduce air in the signal contact connector and maintain dimensional stability to reduce shorts. The resultant shape of the indented shield provides more space between the shield and contact members, which increases electric creep distances.

An additional embodiment of the present approach pertains to a method for forming a contact-surrounding shield that employs indent pressing wheels to form lines of indentation in the shield. Indent pressing wheels are arranged in a pattern around a cylinder such that passing the shield along the axis of the wheel pattern presses the desired indents into the shield. These indent pressing wheels are an improvement over the use of extrusion dies that experience wear of protruding die surfaces during use and subsequent need for frequent replacement of the extrusion dies.

Another embodiment of the present approach relates to keying the contact arrays of the circular connectors to avoid mismatching. The metal shields can also be configured to provide stable keyed structures.

An additional embodiment of the present approach pertains to utilizing the sidewalls of the connector housing to protect the male contacts and to provide electric shock protection

BRIEF DESCRIPTION OF THE DRAWINGS

FIG. 5 is a front elevation view of a right-angle male header circular connector;

FIG. 6 is a cross-sectional view of the right-angle circular connector shown in FIG. 5 taken along line A-A;

FIG. 7 is a cross-sectional view of the right-angle circular connector shown in FIG. 5 taken along line B-B;

FIG. 8 is a perspective view of the right-angle circular connector shown in FIG. 5;

FIG. 9 is another perspective view of the right-angle circular connector shown in FIG. 5;

FIG. 15 is a perspective view of a shield for an embodiment of a signal contact cluster of a circular connector suitable for use with the housing of FIG. 11;

FIG. 15A is a cross-sectional view along the line A-A of FIG. 15;

FIG. 16 is a perspective view of a typical extrusion die;

DETAILED DESCRIPTION OF THE INVENTION

As required, detailed embodiments of the present approach are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

Connectors of this approach have housings that comprise power contact members and a signal contact assembly connector, which can be considered a connector-like assembly, that includes a cluster of signal contact members partially encased in polymeric dielectric material that forms a housing. A shielding material surrounds the housing. The power contact members and the signal contact members can be either male or female. These connectors can house all male contact members, all female contact members or a mixture of male and female contacts. All of the specific embodiments herein show connectors of a generally cylindrical shape with a generally circular cross-section. For many applications, the generally cylindrical shape is that of a right cylinder with a circular cross-section. Generally a circular cross-section has advantages due to its strength, efficient use of space and ease of providing adequate dielectric effect among the contacts and any shielding. Still, other generally cylindrical configurations and cross-sections can be practiced depending upon the application for which the connectors are intended.

Figure 1:
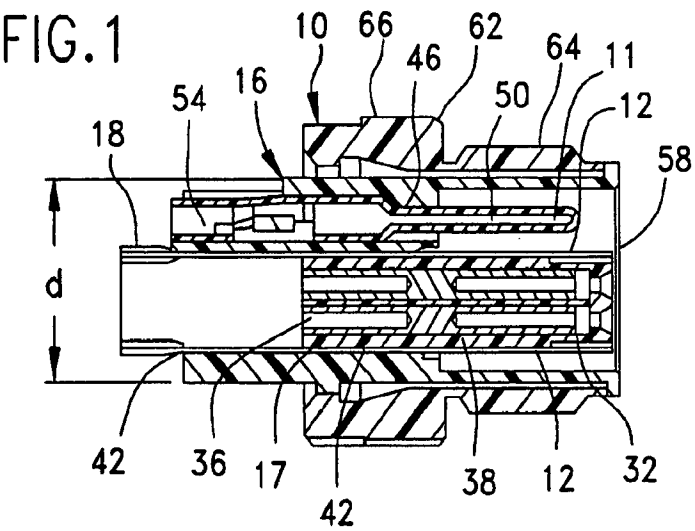
FIG. 1 is a cross-sectional view of a male header circular connector showing a mating face and a connector end.
Figure 2:
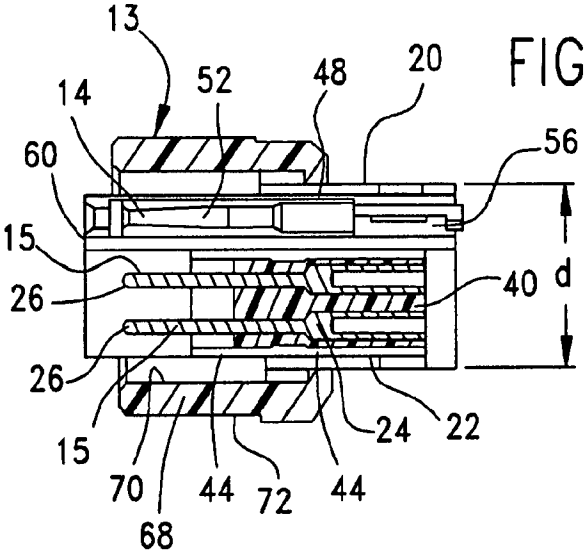
FIG. 2 is a cross-sectional view of a female header circular connector depicting a mating face and a connector end.
Figure 3:
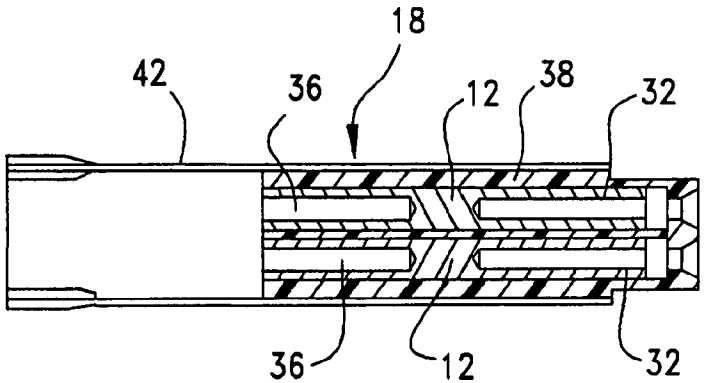
FIG. 3 is a cross-sectional view of a female contact assembly showing a mating face and a connector end.
Figure 4:
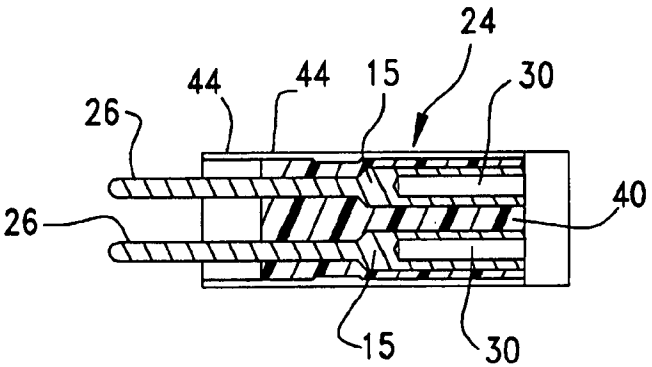
FIG. 4 is a cross-sectional view of a male contact assembly illustrating a mating face and a connector end.

FIG. 1 illustrates a hybrid header connector, generally designated as 10, with male power contact members 11 and female signal contact members 12. FIG. 2 shows a hybrid header connector, generally designated as 13, suitable for providing a connector assembly with the connector 10. This connector 13 has female power contact members 14 and male signal contact members 15. Header connector 10 suitably has an insulative housing, generally designated as 16, with a portion thereof having a least one signal assembly cavity 17, each for a signal contact. This portion of the insulative housing holds a female signal assembly 18 further illustrated in FIG. 3. Header 13 suitably comprises an insulative housing, generally designated as 20, with a portion thereof having at least one signal assembly cavity 22, each for a signal contact. This portion of the insulative housing receives a male signal assembly 24 additionally depicted in FIG. 4.

The illustrated header connector 10 can be considered a plug connector and the illustrated header connector 13 can be considered a receptacle connector due to their respective configurations with respect to each other. It will be appreciated that the header connector 10 could be configured as a receptacle connector and that header connector 13 could be configured as a plug connector. Typically, each connector will include a plurality of signal contacts in a cluster and a plurality of plug contacts being accommodated in space along the cluster.

Connectors 10 and 13, when in a circular configuration as shown, can have outside diameters "d" of, for example, between about 6 mm and about 15 mm, typically between about 7 mm and about 12 mm. Connectors 10 and 13 can, for example, house between 2 and 8 power contact members and typically between 3 and 6 power contact members. The signal assemblies of connector 10 and circular connector 13, for example, hold between 2 and 8 signal contact members and typically between 3 and 6 signal contact members. Signal assemblies can have diameters, for example, between about 3 mm and about 6 mm, typically between about 4 mm and about 5 mm. Signal contact members typically are generally rod shaped with a signal contact end portion and a connector end portion opposite the contact end. The opposite connector end may be a wire receiving end that is typically socket shaped to receive wire terminal pins or a board mounting end that is suitably pin shaped for insertion into board mounting contact holes. Male signal contact members 15 of signal assembly 24 have male signal contacts or contact pins 26 and wire receiving connector sockets 30. Female signal contact members 12 of signal assembly 18 have female signal contacts or sockets 32 and wire receiving connector sockets 36.

To form female signal assembly 18 and male signal contact assembly 24, female signal contact members 12 and male signal contact members 15, respectively, are clustered or bunched in close proximity but not touching and parallel to one another. Sides of the signal contact members are suitably covered with molded dialectic material such as dielectric polymer. The dielectric coatings on the sides of the signal contact members are contiguous, forming a generally cylindrical shaped structure of dielectric material providing a conforming dielectric housing 38, with multiple female signal contact members 12 partially encased thereby and with dielectric material providing a conforming dielectric housing 40 with multiple male signal contact members 15 partially encased thereby.

The female signal contact members 12 encased in dielectric material of housing 38 and male signal contact members 15 encased in dielectric of housing 40 are then covered with a conductor material shields 42 and 44, respectively, to improve data transmission performance, especially in adverse EMI/EMC conditions. Shields 42 and 44 typically are cylindrically shaped and closely fit with the encased signal contact members. The cylindrically shaped shields can have a "star" shaped cross-section or other cross-sectional configuration that accommodates the number and relative spacing and positioning of the signal contacts or pins.

With particular reference to the so-called "star" shape, multiple lines of indentation can be pressed into the sidewall of a cylindrical member parallel to the longitudinal axis so as to form the "star" shaped shield. These indentations strengthen the shield and serve to reduce air in the shielded column or volume of material and maintain dimension stability to reduce the possibility of shorts. The encased and shielded signal contact members form signal assemblies that are themselves connectors and may be employed within connectors as clustered signal insert units.

The thickness of the dielectric material located between the signal contact members and the shielding is fashioned to be adequate to electronically insulate the signal contact members from each other while minimizing the space or volume occupied by the contact cluster. It will be appreciated, however, that the signal contact members, dielectric encasing material and the shield form a capacitor that may interfere with data transmission. To maintain size restrictions and maintain good data transmission it is desired to employ dielectric material with dielectric constants suitably below about 2.6. Suitable dielectric materials and their respective dielectric constants are: Teflon® polytetrafluoro ethylene, 2.1; polypropylene, 2.2; and LCP (liquid crystal polymer), 2.5.

Signal cavity 17 and signal cavity 22 are formed in header housing 16 and header housing 20, respectively, and typically near the outside wall of the respective housing bodies to maximize space available for power contact members. Power contact members are generally rod shaped with a contact end that may be a male contact such as pin or a female contact such as a socket. The opposite end may be a wire receiving end that is typically socket shaped to receive wire terminal pins or board mounting ends that are suitably pin shaped for insertion into board mounting contact holes. The illustrated power contact members 11 positioned in housing 16 have male power contacts or contact pins 50 at one end portion and line receiving sockets 54 at the opposite end portion of these power contact members. The illustrated power contact members 14 positioned in housing 20 have female power contacts or sockets 52 at one end portion and line receiving sockets 56 at the opposite end portion of these power contact members.

Male power contact cavities 46 and female power contact cavities 48 are positioned within housing 16 and housing 20, respectively, in this illustrated embodiment. Power contact members 11 and power contact members 52 are seated within male power contact cavities 46 and female power contact cavities 48, respectively, in this illustrated embodiment. Arrays of power contact members are suitably placed within connectors in patterns such as linear, arcuate or staggered patterns. The arrays, suitably, are unique to ensure proper keying and avoid mismatching. Since the male contacts are suitably not accessible with the illustrated arrangement, the male contacts are protected, are less likely to be bent by unintended physical contact with another component or surface, and electric shock protection is provided. Power can be AC or DC, and the current and voltage transmitted thereby is selected in accordance with the desired end use for the connectors.

Connector 10 has mating end 58 that is matable with mating end 60 of connector 13. Mated connectors suitably are locked together with screw locking connectors affixed to their respective mating ends. The illustrated circular plug connector 10 with the mating end 58 has a screw locking component 62 comprised of thread 64 and gripping sleeve 66. The illustrated circular receptacle connector 13 with the mating end 60 has a screw locking component 68 that includes a thread 70 and a gripping sleeve 72.

Figure 10:
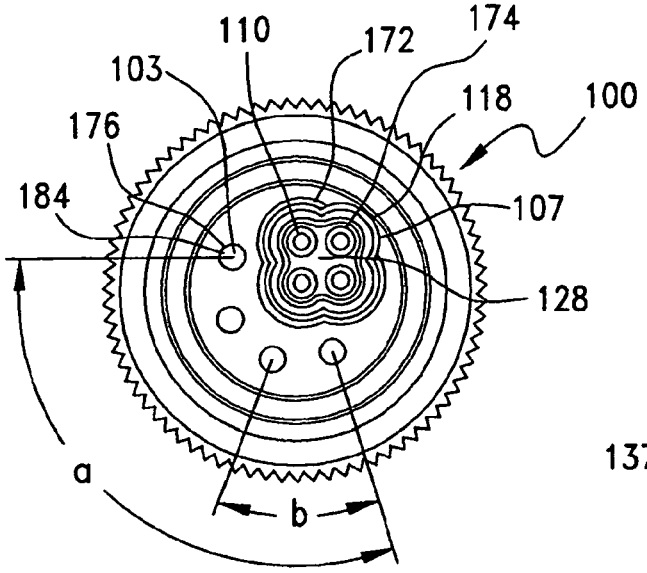
FIG. 10 is an enlarged view showing more detail of the mating face of circular connector shown in FIG. 5.
Figure 12:
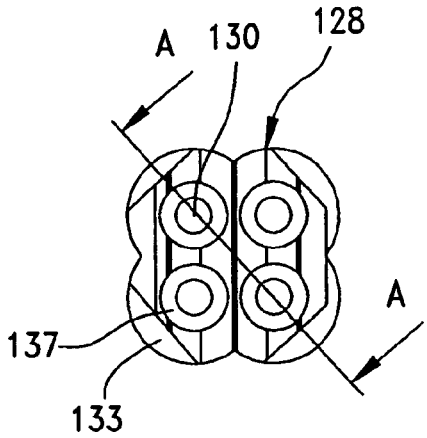
FIG. 12 is a cross-sectional view of the dielectric material housing shown in FIG. 11 taken along line B-B of FIG. 11.
Figure 11:
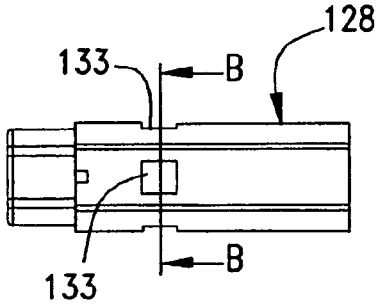
FIG. 11 is a side elevation view of a dielectric material housing for an embodiment of a signal contact cluster of a circular connector.
Figure 13:
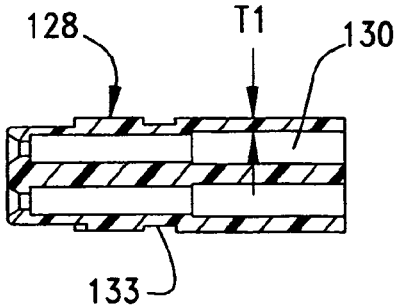
FIG. 13 is a cross-sectional view of the dielectric material housing shown in FIG. 11 taken along line A-A of FIG. 12.

FIGS. 5, 6, 7, 8, 9 and 10 illustrate an embodiment of a hybrid "M12" male header circular connector, generally shown as 100, that is attached to a right angle wire housing, generally shown as 101. Circular connector 100 comprises, in a "quad4" orientation that is typically used for low-cross-talk data transmission, an insulative housing, generally designated as 102, four male power contact members 103, as illustrated in FIG. 10, and a female contact assembly 107, which can be considered a connector-like component, with four female signal contacts 110. Female signal contacts 110 are part of respective female signal contact members 118. The female signal contact members are rod-shaped conductors with a female connector at the end of the rod opposite the female signal contact end. To form female signal assembly 107, which can be considered a connector-like component, female signal contact members 118 are clustered or bunched in close proximity and spaced from (not touching) and are parallel to one another. Furthermore, each of the four signal contact members 118 are substantially an equal distance from the center of the cluster and are in a square pattern as shown in FIG. 10. The sides of the signal contact members are covered with dialectic material, suitably an injection molded dielectric material as shown in FIGS. 11, 12, 13 and 14. The dielectric material provides a dielectric housing 128. Dielectric housing is an elongated structure with a cross-section that is in a generally "star shaped" pattern as shown in FIG. 12. The signal contact members 118 are inserted into respective cavities 130 within dielectric material 128. Dielectric material 128 can also have interference surfaces 133.

The dielectric material housing 128 with the signal contact members is placed within a shield 138, shown in FIG. 15, to improve data transmission performance in adverse EMI/EMC conditions and to form female signal contact assembly 107 that is itself a connector and may be employed within connectors such as circular connectors as a signal insert unit. Shield 138 is also an elongated structure and suitably is a conductor. Shield 138 closely fits over the molded dielectric material housing 128. In signal contact assembly 107 interference indents 122 of shield 138 engage interference-surfaces 133 of dielectric material housing 128 to prevent the movement of the dielectric material housing 128 with respect to the shield 138.

Lines of indentation 141 can be pressed into the sidewall of cylindrical shield 138 parallel to the longitudinal axis of the shield which form a "star shaped" pattern cross section, as shown in FIG. 15A, that is substantially the same shape as the star-shaped pattern of the dielectric housing 128. These indentations also strengthen shield 138 and serve to reduce air in the contact assembly and maintain dimension stability to reduce the possibility of shorts. Pressing lines of indentation into the cylinder shields can be performed by extruding the cylinders through a standard extrusion die, generally shown as 139 in FIG. 16. This, however, results in the sliding of metal over metal which wears on the die requiring frequent replacement of the die.

Figure 21:
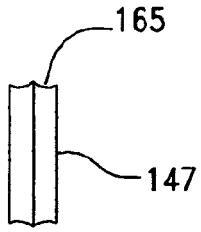
FIG. 21 is a side elevation view of the indent pressing wheel shown in FIG. 20.

FIGS. 17, 18, 19, 20 and 21 illustrate an embodiment of an indent pressing device, generally shown as 145, having a device body, generally shown as 146, with a longitudinal passageway therein, along with indent pressing wheels 147 that have edge portions that enter the passageway. Extending from body 146 are parallel sets of beams 152*a* and 152*b* with wheel 147 rotatably attached by means of axle 159 positioned on the beam pairs 152*a*, 152*b*. In this illustrated embodiment, each indent pressing wheel is suitably at right angles to the pressing wheels on each side of it and parallel to the pressing wheel opposite it. Indent pressing device 145 has cylindrical passageway 163 for receiving a right cylindrical member to form the shield 138. Apertures 164 are positioned to permit indent pressing wheels 147 to extend into passageway 163 and form indentations in shield 138 as the shield cylinder is inserted and removed from indent pressing device 145 while each wheel 147 rolls over the cylinder surface to thereby crease the right cylinder into the cylindrical shield 138. FIG. 21 illustrates the shape of contact surfaces 165 at the circumference of each indent pressing wheel 147. The widest part of star-shaped pattern 129*b*, see FIG. 15A, is defined in part by a widest dimension "W1" and a depth of indentation "D1."

The dielectric material between female signal contact members 118 and shield 138 has a thickness "T1" (FIG. 13) of, for example, between about 0.5 mm and about 2.0 mm and typically between about 0.7 mm and 1.5 mm. The signal contact members, dielectric encasing material and the shield form a capacitor, however, that may interfere with data transmission. To maintain size restrictions and maintain good data transmission it is desired to employ dielectric material with a low dielectric constant, for example, below about 2.6. Examples of suitable materials in this regard are Teflon® polytetrafluoro ethylene, polypropylene, and LCP (liquid crystal polymer).

As shown in FIG. 10, female signal cavity 172 that receives female signal contact assembly 107 is formed in housing 102. To maximize space for power contacts 103, female signal cavity 172 is typically formed near the outside wall 174 of the housing 102. Male power contacts 103 are part of power contact members 176 which are generally rod shaped with a female contact such as a socket end opposite the contact end. Male power contact members 176 are placed within male contact member cavities 184 that are positioned within housing 102 in an arc or circular pattern partially surrounding female signal contact assembly 107. A first and a last male power contact member 176 have an angle "a" of separation between them and adjacent male power contact members 176 have an angle "b" of separation between them. Angle "b" can, for example, be between about 35 degrees and about 60 degrees and typically between about 40 degrees and about 55 degrees. Power contact members can transmit AC or DC power at selected current and voltage.

Figure 24:
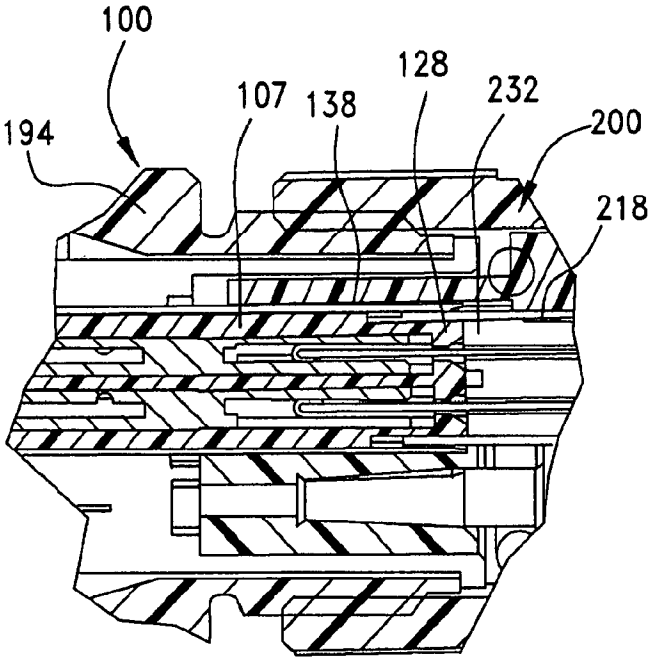
FIG. 24 is an enlarged view, taken at area B of FIG. 23, showing more detail of the circular connector shown in FIG. 22.
Figure 23:
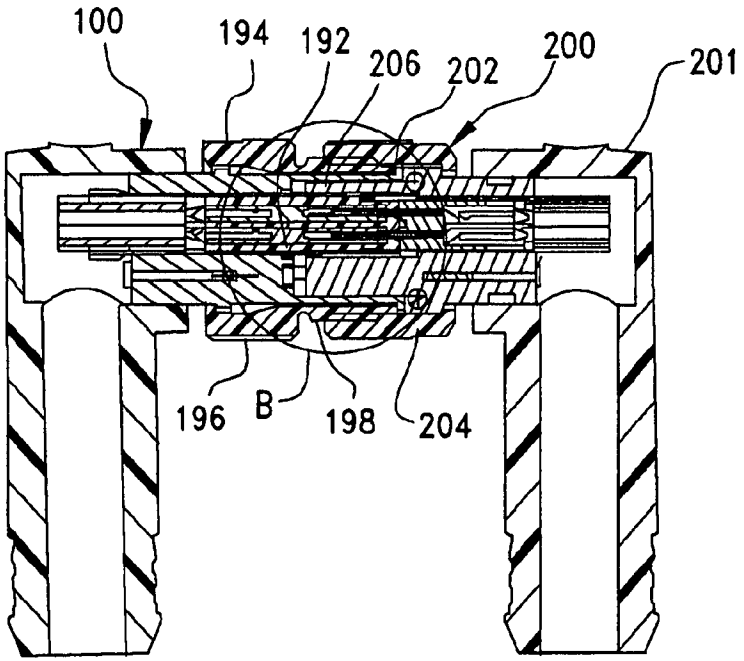
FIG. 23 is a cross-sectional view of the circular connector assembly shown in FIG. 22 taken along line A-A of FIG. 22.
Figure 22:
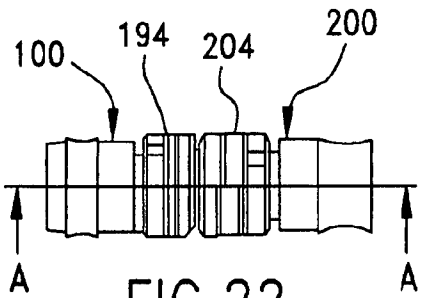
FIG. 22 is a top plan view of an assembly of a right-angle male header circular connector mated with a right-angle female header circular connector.

As illustrated in FIGS. 22, 23 and 24, circular connector 100 has a mating side 192 that is matable with a corresponding female header circular connector such as an embodiment of a hybrid "M12" female header circular connector, generally shown as 200, that is attached to a right angle wire housing, generally shown as 201. Circular connector 100 has "M12" male screw locking connector 194 rotatably affixed to mating side 192 of circular connector 100. Locking connector 194 is comprised of gripping sleeve 196 and male thread section 198, which is matable with female thread section 202 of female locking screw connector 204. Screw connector 204 is rotatably attached to mating side 206 of circular connector 200.

Figure 27:
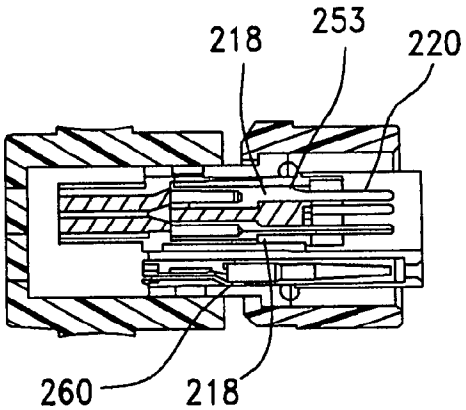
FIG. 27 is a cross-sectional view of the circular connector shown in FIG. 26 taken along line B-B of FIG. 25.
Figure 25:
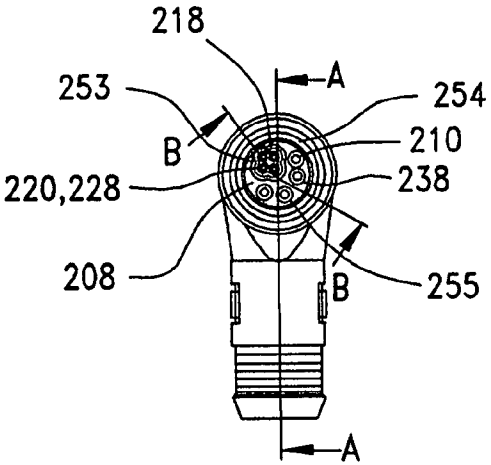
FIG. 25 is a side elevation view of a right-angle female header circular connector suitable for the assembly of FIG. 22.
Figure 26:
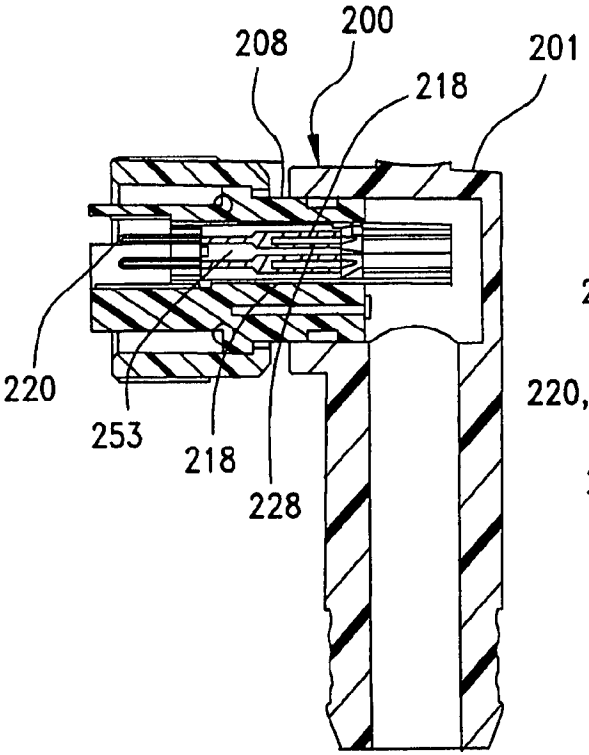
FIG. 26 is cross-sectional view on the circular connector shown in FIG. 25 taken along line A-A of FIG. 25.
Figure 28:
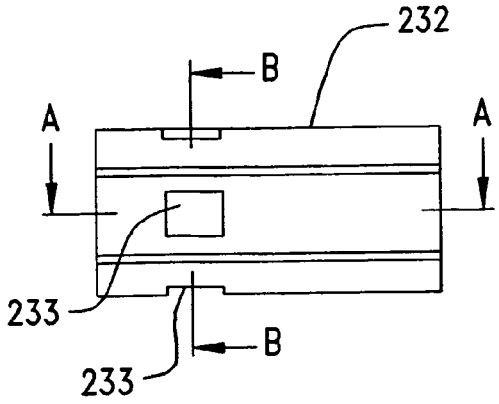
FIG. 28 is a side elevation view of another embodiment of a dielectric material housing for an embodiment of a signal contact cluster of a circular connector.

Circular connector 200, as shown in FIGS. 25, 26 and 27, can have outside diameters similar to circular connector 100 and in a "quadrangle" orientation comprises an insulative housing, generally designated as 208, four female power contacts 210 and a male signal contact assembly 218 with four male signal contacts 220. Male signal contacts 220 are part of male signal contact members 228 respectively. The male signal contact members are rod-shaped conductors with a female connector, suitably for wire connection, on the end portion of the rod opposite the male signal contact end portion. To form male signal assembly 218, male signal contact members 228 are clustered or bunched in close proximity but not touching and are parallel to one another. Furthermore, each of the four signal contact members 118 are substantially an equal distance from the center of the cluster and are in a square pattern as shown in FIG. 10. The sides of the signal contact members are covered with dialectic material, suitably an injection molded dielectric material 232 as shown in FIGS. 28, 29, 30 and 31. The signal contact members 228 are inserted into respective cavities 238 within dielectric material 232. Dielectric material 232 can also have interference surfaces 233.

Figure 31:
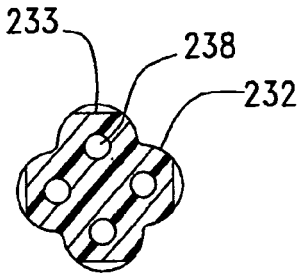
FIG. 31 is a cross-sectional view of the dielectric material housing shown in FIG. 28 taken along line B-B of FIG. 28.
Figure 32:
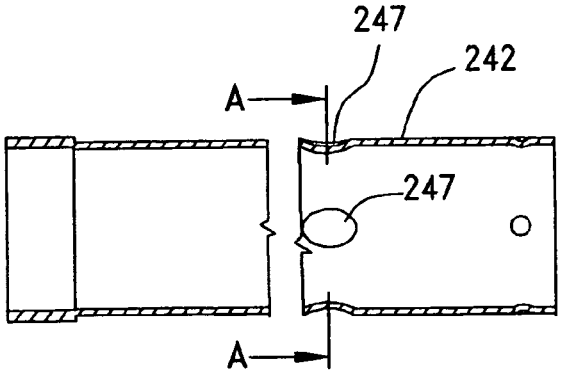
FIG. 32 is a cross-sectional view of a shield for an embodiment of a signal contact cluster of a circular connector suitable for use with the housing of FIG. 31.
Figure 33:
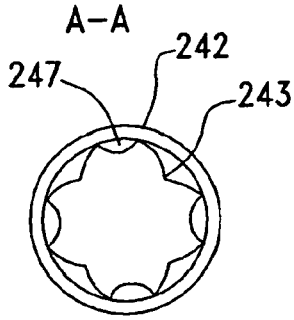
FIG. 33 is a cross-sectional view of the shield show in FIG. 32, along the line A-A of FIG. 33.
Figure 42:
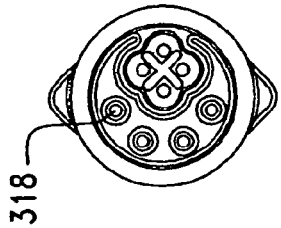
FIG. 42 is a top view of the female header circular connector shown in FIG. 40 showing more detail.

The signal contact members and dielectric material are placed within male signal shield 242 as shown in FIGS. 32 and 33 to improve data transmission performance in adverse EMI/EMC conditions and to form male signal contact assembly 218 as shown in FIG. 27. Shield 242 suitably is a conductor with an elongated structure having a generally star-shaped cross-section pattern 237*b*, as shown in FIG. 31, that is substantially the same as 237*a*. Shield 242 also has a thickness substantially the same as shield 138. Shield 242 closely fits with the molded dielectric material 232.

Lines of indentation 243 can be pressed into the sidewall of cylindrical shield 242 parallel to the longitudinal axis of the shield to form star-shaped pattern 237*b*. Pressing lines of indentation into cylinder shields can be performed by extruding the cylinders through a standard extrusion die or by indent pressing wheels as described above. These indentations strengthen shield 242 and serve to reduce air in the shielded material and maintain dimension stability to reduce the possibility of shorts. The encased and shielded signal contact members form signal contact assembly 218 that is itself a connector and may be employed within circular connectors as a signal insert unit. In signal contact assembly 218 interference indents 247 of shield 242 engage interference surfaces 233 of dielectric material 232 to prevent the movement of dielectric material 232 with respect to shield 242.

Figure 29:
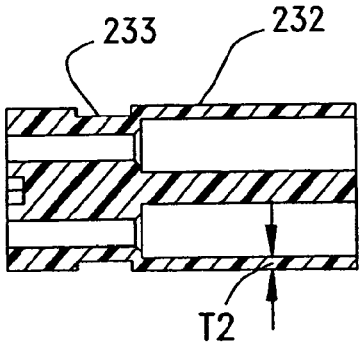
FIG. 29 is a cross section view of the dielectric material housing shown in FIG. 28 taken along line A-A of FIG. 28.
Figure 30:
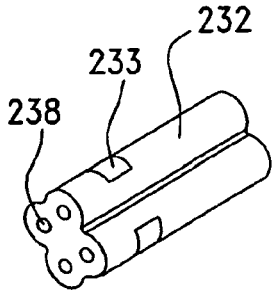
FIG. 30 is a perspective view of the dielectric material housing shown in FIG. 28.

The thickness "T2" shown in FIG. 29, of dielectric material 232 between the four signal contact members and shield 242 can be, for example, similar to the thickness of the dielectric material housing 128. To maintain size restrictions and minimize capacitor interference it is desired to employ dielectric material with low dielectric constants, for example below about 2.6, such as Teflon® polytetrafluoro ethylene, polypropylene, or LCP (liquid crystal polymer). The male signal contact members 228 can transmit signal current, at substantially the same amps and signal volts as female signal contact members 118.

A male signal cavity 253, as seen in FIGS. 25, 26 and 27, is formed in housing 208 and typically near the outside wall 254 of the housing body 208 to maximize space for power contact members. Female power member cavities 255 are positioned within housing 208 in an arc or circular pattern partially surrounding male signal cavity 253. Female power contacts 210 are part of female power contact members 260, which are generally rod shaped with a female contact such as a socket end opposite the contact ends. Female power contact members 260 can have diameters, for example, similar to male power members 176. Angles "a" and "b", power current amps and volts for female power contact members 260 are substantially the same as for male power contact members 176.

Figure 14:
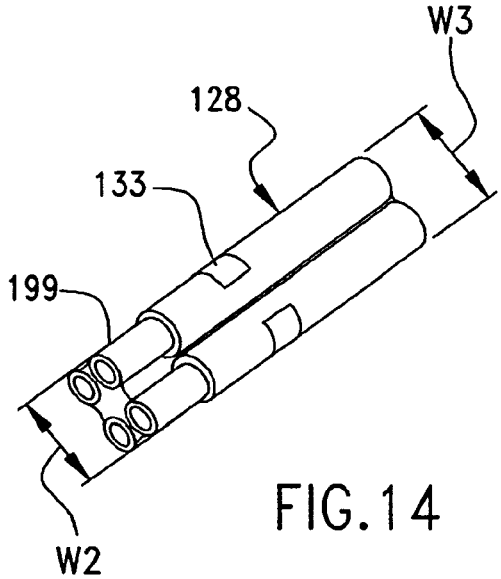
FIG. 14 is a perspective view of the dielectric material housing shown in FIG. 11.
Figure 17:
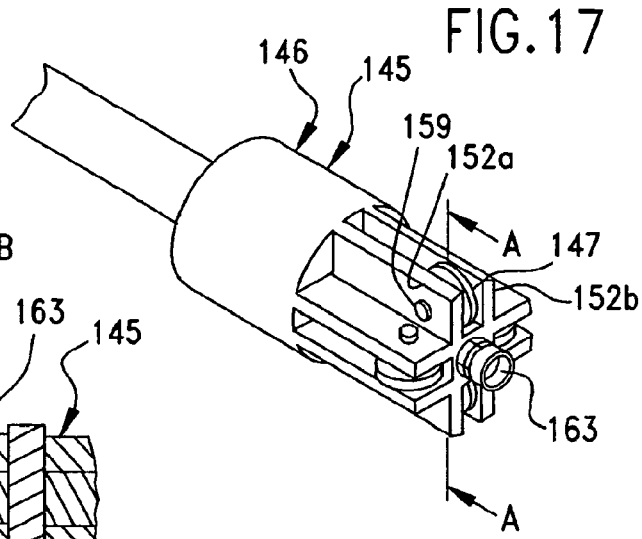
FIG. 17 is a perspective view of an embodiment of an indent wheel pressing device for shaping an embodiment of a shield.
Figure 18:
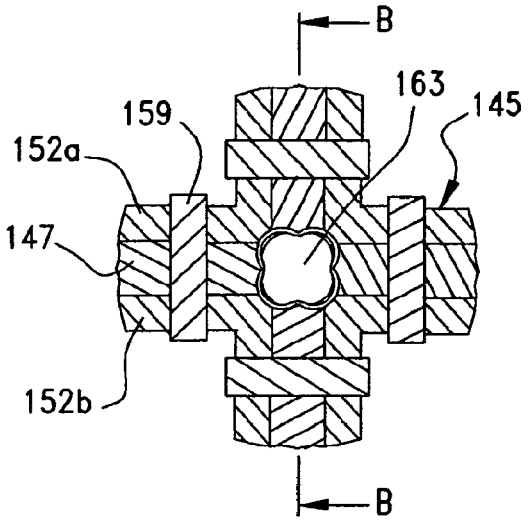
FIG. 18 is a cross-sectional view of the indent wheel pressing device shown in FIG. 17 taken along the line A-A of FIG. 17.
Figure 19:
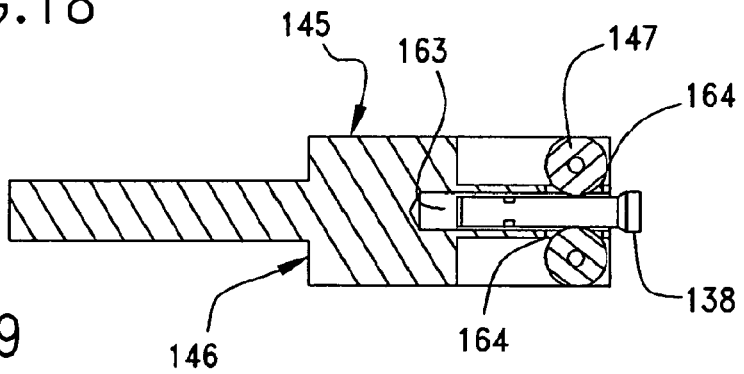
FIG. 19 is a cross-sectional view of the indent wheel pressing device shown in FIG. 17 taken along the line B-B of FIG. 18.
Figure 20:
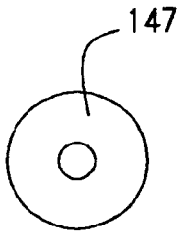
FIG. 20 is a front elevation view of an embodiment of an indent pressing wheel suitable for use in the device of FIG. 17.

FIGS. 23 and 24 illustrate male header circular connector 100 mated with female header circular connector 200. Shield 138 of circular connector 100 is depicted overlapping shield 242 of circular connector 200 to ensure shielding protection at the mating interface, and dielectric material 128 is shown abutting dielectric material 232 when circular connectors 100 and 200 are mated. As seen in FIG. 14, the width "W2" of the insertion end 199 of dielectric material 128 is sufficiently less than the width "W3" of the main body to allow shield 242 to move between shield 138 and insertion end 199 of dielectric material 128.

Figure 34:
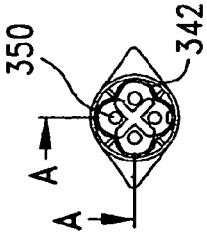
FIG. 34 is a top view of a signal contact cluster assembly prior to contact insertion.
Figure 43:
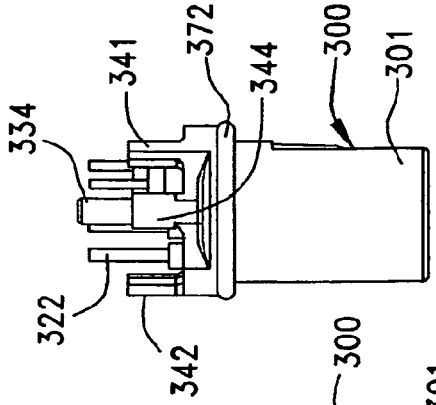
FIG. 43 is an elevation view of the circular connector shown in FIG. 42.
Figure 41:
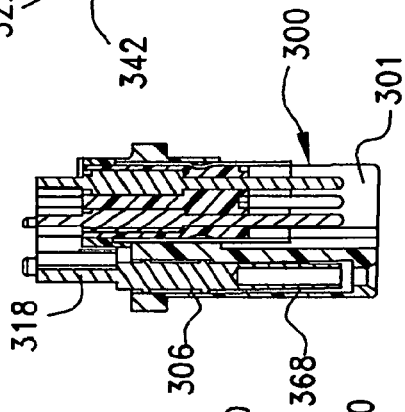
FIG. 41 is a cross-sectional view of the circular connector shown in FIG. 40 taken along line D-D of FIG. 40.
Figure 39:
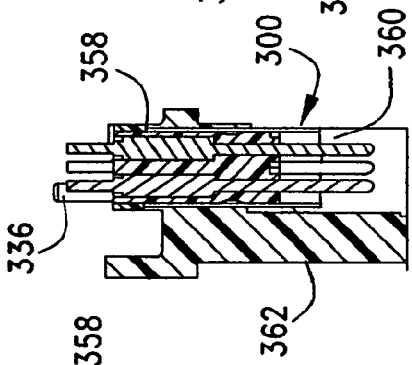
FIG. 39 is a cross-sectional view of the circular connector shown in FIG. 38 taken along line C-C of FIG. 38.
Figure 37:
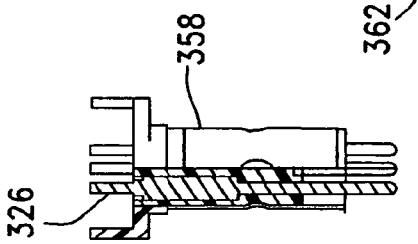
FIG. 37 is a cross-sectional view of the signal contact shown in FIG. 36 taken along line B-B of FIG. 36.
Figure 35:
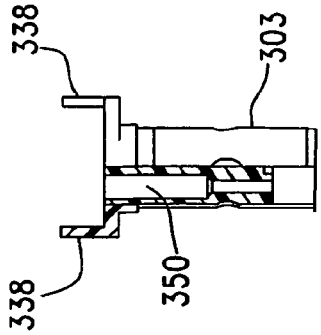
FIG. 35 is a cross-sectional view of the signal contact shown in FIG. 34 taken along line A-A of FIG. 34.

FIGS. 34, 35, 36, 37, 38, 39,40, 41, 42 and 43 illustrate a board mount circular connector, generally shown as 300. Circular connector 300 has a mating end 301 similar to mating end 206 of female header circular connector 200. Mating end 301 has female power contacts that are part of female power contact members 302 and male signal contacts that are part of male signal contact members 310. Female power contact members 302 have male connectors opposite the female power contacts such as power connector pins 318 for board mounting application. Male signal contact members 310 have male board mount contact pins 326 opposite the signal contact end. To aid in properly positioning circular connector 300 on the board, it has polarizing guide pins 334 and 336, as shown in FIGS. 39 and 43. Spacers 338, as seen in FIG. 35, can be provided to control the insertion depth of the mounting pins and permit sufficient space for through-hole-soldering (THR) of the mounting pins to a board.

Figure 40:
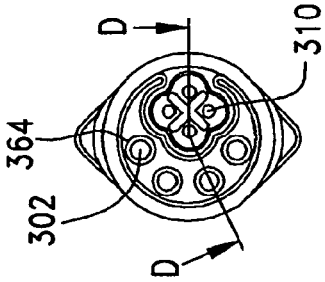
FIG. 40 is a top view of the female header circular connector FIG. 38 shown with power contacts positioned therewithin.
Figure 38:
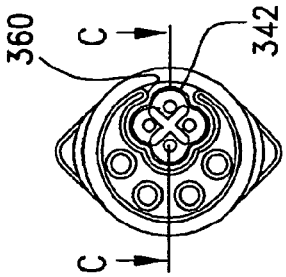
FIG. 38 is a top view of an embodiment of a female header circular connector.
Figure 36:
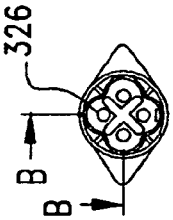
FIG. 36 is a top view of the signal contact of FIG. 34 shown with male contacts positioned therewithin.

To assemble circular connector 300, dielectric material with signal member cavities 350 is placed in shield 342, which then is inserted into a sleeve 303, as shown in FIG. 34. Male signal contact members 310 are placed in signal member cavities 350 to form male signal contact assembly 358 as illustrated in FIG. 40. Signal member assembly 358 is placed in a signal assembly cavity 360 in circular connector housing 362 as seen in FIG. 39. FIG. 40 depicts female power contact members 302 added to respective power member cavities 364. The cluster of signal contact members is within a separately defined portion of the insulative housing, this cluster of signal contact members being generally within and offset to a side of the insulative housing, which can be considered offset to a side of the power contact portion of the insulative housing. Thus, an orientation is provided for the signal contact members cluster that can be considered as biased to one side of the connector. FIG. 43 shows the addition of 0-ring 372 to housing 362.

Figure 44:
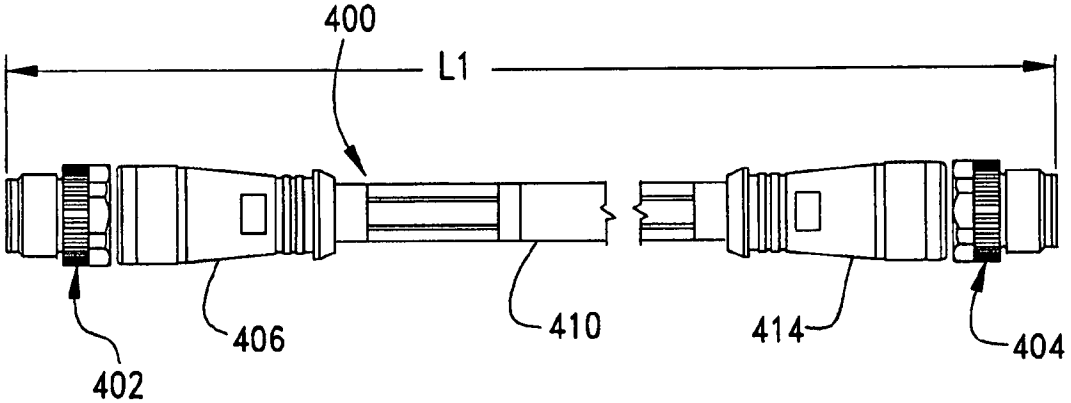
FIG. 44 is a side elevation view of an embodiment of a of a cordset.
Figure 45:
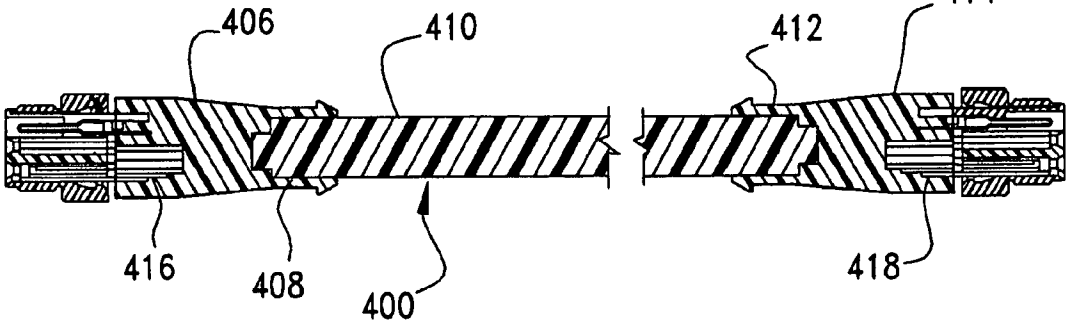
FIG. 45 is a cross-sectional view of the cordset shown in FIG. 44.

FIGS. 44 and 45 illustrate an "M12" hybrid circular connector cordset, generally shown as 400, comprising a first male header circular connector, generally shown as 402, and second male header circular connector, generally shown as 404. Both circular connector 402 and circular connector 404 can be substantially similar to male header circular connector 100 described above. First circular connector 402 is connected to first straight wire housing 406 that in turn attaches to a first end portion 408 of cord 410. Second end portion 412 of cord 410 is attached to second straight wire housing 414 connected to second circular connector 404. Four signal wires in fixed arrangement and four power wires in fixed arrangement connect to connector end 416 of first circular connector 402 which pass through first straight line housing 406, cord 410 and second straight line housing 414 and attach in fixed arrangement to connector end 418 of second circular connector 404.

It will be understood that there are numerous modifications of the illustrated embodiments described above which will be readily apparent to one skilled in the art, such as many variations and modifications of the circular connectors and/or its components including combinations of features disclosed herein that are individually disclosed or claimed herein, explicitly including additional combinations of such features, or alternatively other types of circular connectors. Also, there are many possible variations in the materials and configurations. These modifications and/or combinations fall within the art to which this invention relates and are intended to be within the scope of the claims, which follow.

The invention claimed is:

1. A connector comprising:

a generally cylindrically shaped insulative housing having a plurality of power contact cavities within a power contact portion of the housing and a plurality of signal contact cavities within a signal contact portion of the housing, the signal contact portion being separately defined from the power contact portion;

a signal contact assembly within the signal contact portion of the insulative housing, the signal contact assembly having a plurality of rod-shaped signal contact members within respective signal contact cavities, the signal contact members are arranged in close proximity to, spaced from and generally parallel to one another, a housing of shaped dielectric material encasing the signal contact members, and a shaped conductive shield in contact with the dielectric material housing at a location spaced outwardly of the signal contact members;

a plurality of rod-shaped power contact members within respective power contact cavities, each at a location outside of the signal contact portion of the housing; and the shaped conductive shield has a generally cylindrical cross-section and has multiple lines of indentation in the side wall of the cylindrical shield parallel to the longitudinal axis of the shield.

2. The connector according to claim 1, wherein the signal contact portion is offset to a side of the power contact.

3. The connector according to claim 1, wherein the connector can transmit data at 100 Mbps or greater.

4. The connector according to claim 1, wherein the shaped conductive shield has an inside cross-section complementary with an outside cross-section of the dielectric material housing.

5. The connector according to claim 1, wherein the dielectric material of the dielectric material housing has a dielectric constant of less than about 2.6.

6. The connector according to claim 1, wherein the power contact members form an arcuate pattern and wherein an angle of separation between adjacent power contacts is between about 35 degrees and about 60 degrees.

7. The connector according to claim 1, wherein the number of power contact cavities and the number of power contact members is from 2 to about 8.

8. The connector according to claim 1, wherein the dielectric material between the signal contact members and the shield is between about 0.5 mm and about 2.0 mm.

9. The connector according to claim 1, wherein the number of signal contact cavities and the number of signal contact members is from about 2 to about 8.

10. The connector according to claim 1, wherein the signal contact assembly is generally circular in cross-section, and the diameter of the signal contact assembly is between about 3 mm and about 6 mm.

11. The connector according to claim 1, wherein the insulative housing is generally circular in cross-section, and the diameter of the insulative housing is between about 6 mm and about 15 mm.

12. The connector according to claim 1, wherein the rod-shaped signal contact members have a male or female signal contact end portion and have an opposite male or female signal connector end portion, and wherein the rod-shaped power contact members have a male or female contact power end portion and have an opposite male or female power contact end portion.

13. The connector according to claim 12, wherein the connector comprises a male power contact end portion, and the signal contact assembly has female signal contact end portions.

14. The connector according to claim 1, wherein the dielectric material of the signal contact assembly is selected from the group consisting of a polytetrafluoro ethylene, a polypropylene, and a liquid crystal polymer.

15. The connector according to claim 1, wherein the connector further comprises a plug connector or a receptacle connector.

16. The connector according to claim 1, wherein the power contact portion and power contact members comprise a connector component, and wherein the signal contact assembly comprises a signal connector component, whereby the connector component and the signal connector component provide a connector within a connector.

17. A connector assembly comprising a plug connector and a receptacle connector, the connectors being selectively engageable with each other, each of the plug connector and receptacle connector comprising:

a generally cylindrically shaped insulative housing having a power contact portion of the housing and a signal contact portion of the housing, the signal contact portion being separately defined while being generally within and offset to a side of the power contact portion;

a signal contact assembly within the signal contact portion of the insulative housing, the signal contact having a plurality of rod-shaped signal contact members therewithin, the signal contact members are arranged in close proximity to, spaced from and generally parallel to one another, a housing of shaped dielectric material encasing the signal contact members, and a shaped conductive shield in contact with the dielectric material housing at a location spaced outwardly of the signal contact members;

a plurality of rod-shaped power contact members within the power contact portion of the insulative housing, each power contact member being at a location outside of the signal contact portion of the housing; and the shaped conductive shield has a generally cylindrical cross-section and has multiple lines of indentation in the side wall of the cylindrical shield parallel to the longitudinal axis of the shield.

18. The connector assembly according to claim 17, wherein the shaped conductive shield has an inside cross-section complementary with an outside cross-section of the dielectric material housing.

19. The connector assembly according to claim 18, wherein the rod-shaped signal contact members have a male or female signal contact end portion and have an opposite male or female signal connector end portion, and wherein the rod-shaped power contact members have a male or female contact power end portion and have an opposite male or female power contact end portion.

20. The connector assembly according to claim 17, further including a connector cordset in connective communication with the connectors.

21. The connector assembly according to claim 17, wherein the power contact portion and power contact members comprise a connector component, and wherein the signal contact assembly comprises a signal connector component, whereby the connector component and the signal connector component provide a connector within a connector.

22. A signal connector comprising:

a cluster of a plurality of rod-shaped signal contact members that are arranged in close proximity to, spaced from and generally parallel to one another;

a generally cylindrically shaped housing of dielectric material encasing the signal contact members, the housing of dielectric material having an outer surface;

a generally cylindrically shaped conductive shield in contact with the outer surface of the dielectric material surface, the conductive shield having an inner surface complementary to the outer surface of the housing of dielectric material; and the shaped conductive shield has a generally cylindrical cross-section and has multiple lines of indentation in the side wall of the cylindrical shield parallel to the longitudinal axis of the shield.

23. The signal connector according to claim 22, wherein the rod-shaped signal contact members have a male or female signal contact end portion and have an opposite male or female signal connector end portion.

24. A device for forming longitudinal indents in a generally cylindrical conductive shield for a signal connector, comprising:

a body having an elongated passageway longitudinally oriented therewithin;

a plurality of beams, each rotatably supporting a wheel member having a raised contact surface;

the raised contact surface of the wheel member protrudes into the elongated longitudinal passageway; and the elongated longitudinal passageway is sized and shaped to slidably receive a conductive cylinder while engaging the raised contact surface of the wheel member, thereby forming longitudinal indents and the conductive shield having same.

25. The device in accordance with claim 24, wherein the beams support four wheels, each of the wheels being oriented approximately perpendicular to the other, whereby the longitudinal indents are generally equally spaced from each other along the conductive shield to form a generally star-shaped cross-sectional pattern in the conductive shield.

* * * * *